US010021473B2

(12) United States Patent
Ogata et al.

(10) Patent No.: US 10,021,473 B2
(45) Date of Patent: Jul. 10, 2018

(54) DIGITAL SPEAKER, SPEAKER SYSTEM, AND EARPHONES

(71) Applicant: DAI-ICHI SEIKO CO., LTD., Kyoto-shi, Kyoto (JP)

(72) Inventors: Kenji Ogata, Ogori (JP); Akihiko Hosaka, Tokyo (JP); Yoshiyuki Watanabe, Tokyo (JP)

(73) Assignee: DAI-ICHI SEIKO CO., LTD., Kyoto (JP)

( * ) Notice: Subject to any disclaimer, the term of this patent is extended or adjusted under 35 U.S.C. 154(b) by 0 days.

(21) Appl. No.: 15/575,256

(22) PCT Filed: May 17, 2016

(86) PCT No.: PCT/JP2016/064630

§ 371 (c)(1),
(2) Date: Nov. 17, 2017

(87) PCT Pub. No.: WO2016/186114

PCT Pub. Date: Nov. 24, 2016

(65) Prior Publication Data

US 2018/0139527 A1 May 17, 2018

(30) Foreign Application Priority Data

May 20, 2015 (JP) ..... 2015-102347

(51) Int. Cl.
*H04R 1/10* (2006.01)
*H04R 17/00* (2006.01)
(Continued)

(52) U.S. Cl.
CPC ..... *H04R 1/1016* (2013.01); *H04R 1/24* (2013.01); *H04R 3/12* (2013.01); *H04R 17/00* (2013.01)

(58) Field of Classification Search
CPC ..... H04R 1/086; H04R 1/1016; H04R 1/227; H04R 2201/401; H04R 2203/12;
(Continued)

(56) References Cited

U.S. PATENT DOCUMENTS 6,829,131 B1 * 12/2004 Loeb ..... H04R 19/005 361/115
9,148,712 B2 * 9/2015 Dehe ..... H04R 1/005
(Continued)

FOREIGN PATENT DOCUMENTS

JP 58-104598 A 6/1983
JP 59-128900 A 7/1984
(Continued)

OTHER PUBLICATIONS

International Search Report and Written Opinion (International Application No. PCT/JP2016/064630); dated Aug. 2, 2016.

*Primary Examiner* — Lun-See Lao
(74) *Attorney, Agent, or Firm* — Howard & Howard Attorneys PLLC

(57) ABSTRACT

A digital speaker (1) is provided that is equipped with a piezoelectric element (4) including n electrodes (51, 52, 53) spaced apart from one another. Sound pressure is adjusted according to the surface area of the electrodes (51, 52, 53), and all the electrodes (51, 52, 53) can be driven by the same voltage. A speaker system is provided that uses the digital speaker (1) as a tweeter (11), or as all the speakers including a woofer (13). By this speaker system, earphones (8) are provided that are miniaturized and have high sound quality.

7 Claims, 2 Drawing Sheets

(51) Int. Cl.
*H04R 3/12* (2006.01)
*H04R 1/24* (2006.01)

(58) Field of Classification Search
CPC ..... H04R 2307/201; H04R 2307/207; H04R 2420/00; H04R 2460/03; H04R 2499/13; H04R 29/00; H04R 29/008; H04R 31/003; H04R 31/006; H04R 3/06; H04S 3/008; H04S 5/00; H04S 2400/01; H04S 2400/03; H04S 2400/09; H04S 2400/11; H04S 2420/01; H04S 2420/03; H04S 3/02; H04S 7/30; H04S 7/301; H04S 7/303
USPC ..... 381/74, 98, 56–58, 1, 300, 87, 332, 333; 700/94
See application file for complete search history.

(56) References Cited

U.S. PATENT DOCUMENTS

| | | | | |
|---|---|---|---|---|
| 9,900,700 | B2 * | 2/2018 | Casset ..... | H04R 7/26 |
| 2013/0294636 | A1 * | 11/2013 | Cassett ..... | H04R 1/02 381/386 |
| 2016/0309274 | A1 * | 10/2016 | Ma ..... | H03M 3/04 |
| 2018/0098139 | A1 * | 4/2018 | Arevalo Carreno ... | H04R 1/005 |

FOREIGN PATENT DOCUMENTS

| | | | |
|---|---|---|---|
| JP | 09-266599 | A | 10/1997 |
| JP | 2000-174854 | A | 6/2000 |
| JP | 2013-055527 | A | 3/2013 |

* cited by examiner

DIGITAL SPEAKER, SPEAKER SYSTEM, AND EARPHONES

CROSS-REFERENCE TO RELATED APPLICATIONS

This application is a U.S. National Phase of International Application No. PCT/JP2016/064630, filed on May 17, 2016, which claims the benefit of Japanese Patent Application No. 2015-102347, filed on May 20, 2015, including the specification, claims, and drawings, the entire disclosures of which is incorporated by reference herein.

TECHNICAL FIELD

The present disclosure relates to a digital speaker for generation of sound on the basis of a digital signal, a speaker system equipped with the digital speaker, and earphones equipped with the speaker system.

BACKGROUND ART

A digital speaker is known that generates sound on the basis of a digital signal (for example, see Patent Literature 1). The digital speaker can achieve high sound quality due to a lack of deterioration of sound quality by an analog system from audio amps and the like during transmission to the speaker. Further, for small-sized equipment such as mobile phones, the use of a digital terminal as a terminal for the output of sound is preferred from the standpoint of equipment design due to the digital terminal being smaller than an analog terminal (so-called pin jack), and thus demand is increasing for digital speakers, which generate sound on the basis of a digital signal output from the digital terminal.

A digital speaker requires an array of separate sound generating devices for each bit of the inputted digital signal. However, due to speaker units using a permanent magnet and voice coil often being utilized conventionally as each of the sound generating devices, a problem occurs due to mutual induction between coils. Further, differences between the individual coils also cause a problem of decreased sound quality. Also miniaturization is difficult due to the requirement that the number of speakers matches the bit count.

Further, Patent Literature 2 discloses a digital speaker in which the number of electrodes arranged on one piezoelectric element is the same as the bit count. Either the voltage applied to each electrode differs in accordance with the corresponding bit, or the surface area of each of the electrodes corresponds to the bit. However, Patent Literature 2 does not disclose a circuit applying a voltage to each of the electrodes, and enablement cannot be realized using the disclosed configuration. In particular, how voltage is applied to a central portion of the piezoelectric element is unclear. Further, the voltage of each bit is applied separately to the central portion and circumferential portion of the piezoelectric element, and thus frequency characteristics of each bit in the piezoelectric element are not uniform.

CITATION LIST

Patent Literature

Patent Literature 1: Unexamined Japanese Patent Application Kokai Publication No. 2000-174854

Patent Literature 2: Unexamined Japanese Patent Application Kokai Publication No. H09-266599

SUMMARY OF INVENTION

Technical Problem

The object of the present disclosure is to provide a digital speaker that has high sound quality when miniaturized, a speaker system including the digital speaker, and earphones including the speaker system.

Solution to Problem

The digital speaker of the present disclosure includes:

a signal division circuit for dividing an inputted digital signal into bit units;

n D/A converters for, based on n post-division digital signals divided by the signal division circuit, output of a voltage in the bit units, n being greater than or equal to 2; and one piezoelectric element including n electrodes, spaced apart from each other, for receiving the voltage output from the D/A converters.

The following formula is satisfied:

$$Si \cdot Vi = r2^{i-1}$$

In the formula, Vi is the voltage output from the D/A converter processing a post-division digital signal for an i-th bit from a lower order bit of the digital signal, i is an integer ranging from 1 to n, Si is a surface area of an electrode of the electrodes receiving the voltage Vi, and r is a constant.

According to this configuration, a digital speaker can be constructed that uses one piezoelectric element by applying the fact that sound pressure generated by the piezoelectric element is proportional to both the voltage and the surface area. Further, the digital speaker can be miniaturized due to construction from one piezoelectric element. Further, vibration is generated by the piezoelectric element, and thus mutual induction between coils is not a problem.

For the digital speaker of the present disclosure, Vi is a constant.

In accordance with this configuration, the same voltage is applied to all the electrodes.

In For the digital speaker of the present disclosure, a voltage generated by one voltage source is supplied to all of the n electrodes.

Due to the ability to use one voltage generator to generate the same voltage for application to all of the electrodes according to this configuration, this configuration has few problems of unit-to-unit differences.

In the digital speaker of the present disclosure, the piezoelectric element is disk shaped, the surface of the piezoelectric element is divided into concentric circular regions, each electrode of the n electrodes is disposed in 2 or more of the regions, and the other n−1 electrodes are disposed in a separating portion of the electrodes disposed in the 2 or more regions.

According to this configuration, the electrode of each bit can be disposed without bias on the surface of the piezoelectric element. Thus the frequency characteristics of the entire piezoelectric element are improved.

The speaker system of the present disclosure is for dividing a sound range by frequency band and outputting the divided sound ranges separately from 2 or more speakers. The speaker for outputting the sound range of a highest frequency band is the aforementioned digital speaker.

Due to such configuration, the digital speaker can be used as a tweeter.

In the speaker system of the present disclosure, all the speakers are the aforementioned digital speaker.

Due to such configuration, the speaker system can be miniaturized due to use of the digital speaker not only as a tweeter but also as the woofer, and as may be required, the squawker and the like.

The earphones of the present disclosure include the aforementioned speaker system.

Due to such configuration, earphones can be provided that use the miniaturized speaker system.

Advantageous Effects of Invention

According to the present disclosure, a digital speaker can be provided that is miniaturized and has high sound quality. A miniaturized speaker system can be provided that includes the miniaturized digital speaker, and a high sound quality speaker system can be provided in earphones, which are a miniaturized device.

DESCRIPTION OF EMBODIMENTS

Embodiment 1 of a digital speaker and Embodiment 2 of earphones are indicated below.

Embodiment 1

Figure 1:
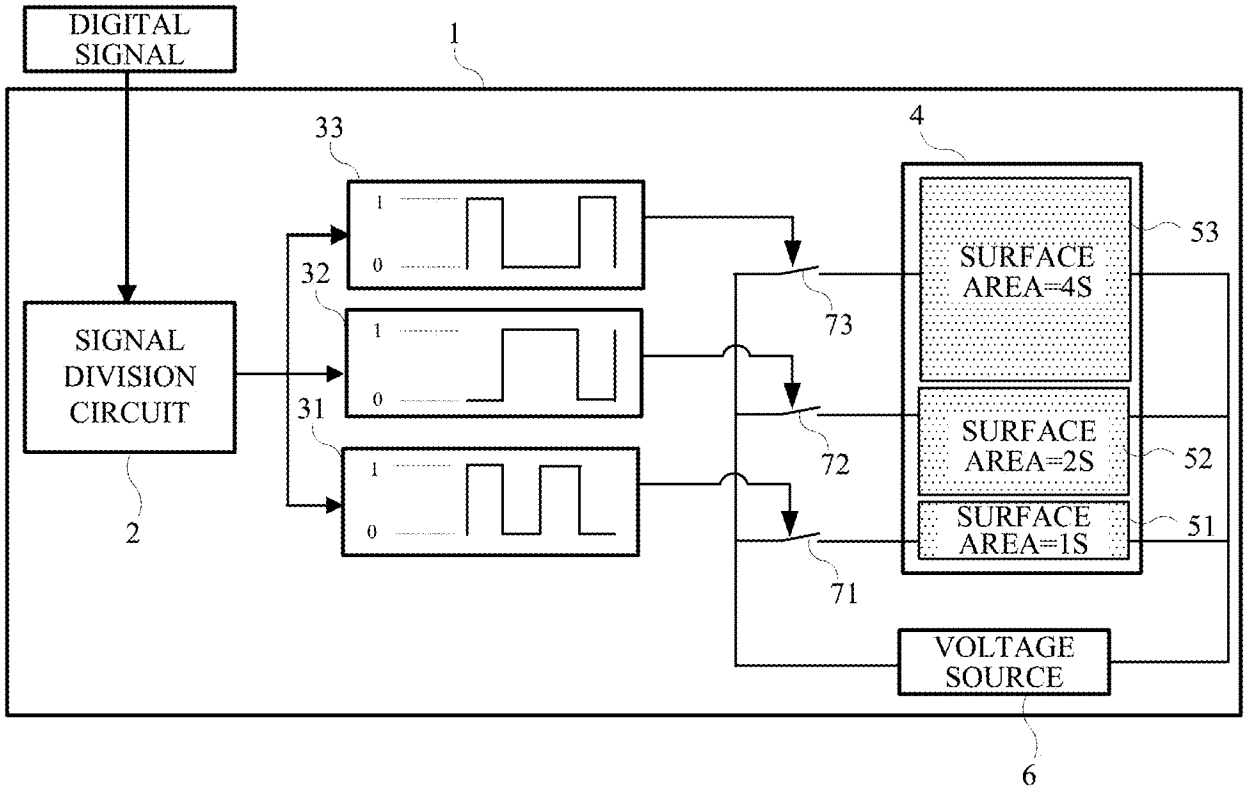
FIG. 1 is a drawing illustrating a configuration of a digital speaker.

FIG. 1 is a drawing illustrating a configuration of a digital speaker 1. The digital speaker 1 includes a signal division circuit 2, a piezoelectric element 4, electrodes 51, 52, and 53, a voltage source 6, and switches 71, 72, and 73.

The signal division circuit 2 divides an inputted digital signal into bit units and generates post-division digital signals 31, 32, and 33. The post-division digital signal 31 is a signal indicating a lowest-order bit, the post-division digital signal 32 is a signal indicating a middle-order bit, and the post-division digital signal 33 is a signal indicating a highest-order bit. Although the digital signal in the present embodiment is taken to be a 3 bit signal, the digital signal may have 4 or more bits.

The piezoelectric element 4 converts voltage into force. The piezoelectric element 4, for example, is formed from a ceramic such as lead zirconate titanate (PZT) or the like. In practice, the piezoelectric element 4 is formed into a disk shape.

The electrodes 51, 52, and 53 are electrodes attached to the piezoelectric element 4. The electrode 51 corresponds to the post-division digital signal 31 of the lowest-order bit, the electrode 52 corresponds to the post-division digital signal 32 of the middle-order bit, and the electrode 53 corresponds to the post-division digital signal 33 of the highest-order bit.

Ratios of the surface areas of the electrodes 51, 52, and 53, corresponding to the magnitudes of the values indicated by each of the bits, are 1:2:4 (1S:2S:4S). In general terms not limited to 3 bits, a surface area Si of the electrode for the i-th bit (i=1, n, where n is an integer) from the lower order of the digital signal is given by Si=r2i−1 (r is a constant).

The voltage source 6 is a voltage source for applying voltages to the electrodes 51, 52, and 53. In the present embodiment, a voltage V is applied to all of the electrodes 51, 52, and 53 from one voltage source 6. The significance of this configuration is described below.

The switches 71, 72, and 73 perform ON-OFF switching of the voltage supply from the voltage source 6 to the electrodes 51, 52, and 53. The switches 71, 72, and 73 are used as electrical switches for performance of electrical opening and closing.

The post-division digital signals 31, 32, and 33 of each of the bit units displays a value of 0 or 1 that changes with the passage of time. Thus if the switch 71, 72, or 73 is used as ON when the value of the post-division digital signal 31, 32, or 33 (and the voltage source 6) is 1, and is used as OFF when the value of the post-division digital signal 31, 32, or 33 is 0, the switches 71, 72, and 73 (and the voltage source 6) form a D/A converter. Thus the switch 71 operates as the D/A converter for processing the post-division digital signal 31 for the first bit from the bottom order of the digital signal, the switch 72 operates as the D/A converter for processing the post-division digital signal 32 for the second bit from the bottom order of the digital signal, and the switch 73 operates as the D/A converter for processing the post-division digital signal 33 for the third bit from the bottom order of the digital signal. Further, the switches 71, 72, and 73 are provided on the basis of the number of the post-division digital signals, and thus the number of switches is n when n post-division digital signals are present (n is an integer greater than or equal to 2).

Operation of the digital speaker 1 is described below.

The digital signal has a prescribed bit count, is sampled at a certain frequency, and is time series data indicating volume. The signal division circuit 2 divides the digital signal into bit units, and generates the post-division digital signals 31, 32, and 33. The post-division digital signals 31, 32, and 33 are sampled at the prescribed frequency to become time series data indicating a value of 0 or 1.

In the digital speaker 1, when the value of the post-division digital signal 31, 32, or 33 is 1, the respective switch 71, 72, or 73 is turned ON, and when the value of the post-division digital signal 31, 32, or 33 is 0, the respective switch 71, 72, or 73 is turned OFF.

When the switch 71, 72, or 73 is turned ON, the voltage V of the voltage source 6 is applied to the respective electrode 51, 52, or 53.

Surface areas of the electrodes 51, 52, and 53 correspond to the magnitudes of the values indicated by the respective bits, and thus on the piezoelectric element 4, voltage of the voltage source 6 is applied to a portion corresponding to the surface area corresponding to the value of the digital signal. The sound pressure is proportional to the surface area to which voltage is applied in the piezoelectric element, and thus the sound pressure corresponding to the value of the digital signal is generated from the piezoelectric element 4.

Further, appropriate design may be used so that the sound pressure is generated by auto-vibration of the piezoelectric element 4, or a vibrating body (of a material having suitable elasticity, such as a metal, a resin, and the like) may be provided that receives the vibration of the piezoelectric element 4.

The value of the digital signal undergoes D/A conversion in bit units in the above manner, and the sound pressure is generated that corresponds to the total of the values of all the bits.

Further, in the D/A conversion, a separate D/A converter may be used for each of the bit units. Further, the sound pressure generated by the piezoelectric element 4, in addition to being proportional to the surface area to which the voltage is applied, is proportional to the applied voltage, and thus rather than setting the surface area ratios of the electrodes 51, 52, and 53 to 1:2:4, the ratios of values of the product of the applied voltage Vi and the surface area Si of the electrodes 51, 52, and 53 may be set to 1:2:4. However, in this case, a separate D/A converter is used for each of the electrodes 51, 52, and 53, and thus a risk remains that sound quality may deteriorate due to unit-to-unit differences between the D/A converters.

One voltage source 6 is used in the configuration of the present embodiment, and thus the output voltages of the D/A converter are equal to one another, and sound quality does not deteriorate on the basis of unit-to-unit differences between the D/A converters. That is to say, even if the voltage V of the voltage source 6 varies, the voltage varies uniformly for all of the electrodes 51, 52, and 53, and thus although the volume changes, sound quality does not deteriorate.

As described above in detail, the digital speaker 1 of the present embodiment includes the signal division circuit 2, the piezoelectric element 4, the electrodes 51, 52, and 53, the voltage source 6, and the switches 71, 72, and 73. D/A conversion is performed by the switches 71, 72, and 73 using one voltage source 6, and thus sound quality does not deteriorate due to unit-to-unit differences between devices. Further, voice coils are not used, and thus the problem of mutual induction between coils does not occur. Thus by use of the digital speaker 1 of the present embodiment 1, the miniaturized digital speaker 1 having high sound quality is achieved using one piezoelectric element 4.

Frequency characteristics in accordance with the arrangement of the electrodes are described below.

Figure 2:
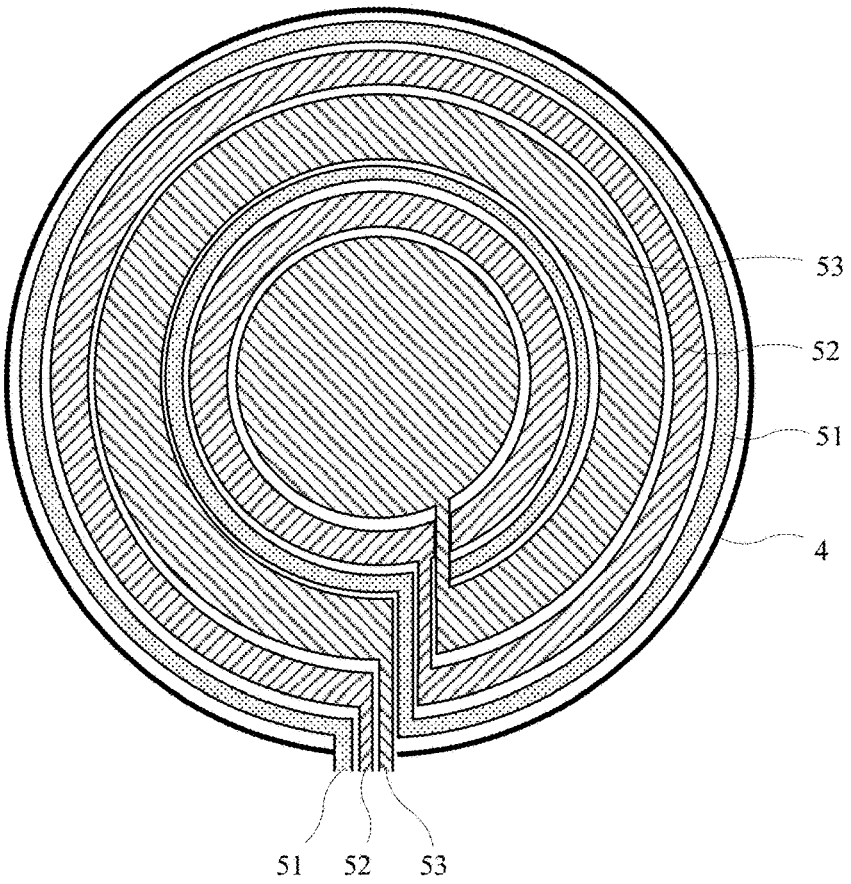
FIG. 2 is a drawing illustrating a layout of electrodes.

FIG. 2 is a drawing illustrating a layout of the electrodes 51, 52, and 53. The piezoelectric element 4 is disk-shaped, and the electrodes 51, 52, and 53 are arranged on the surface of the piezoelectric element 4. In FIG. 2, the electrodes 51, 52, and 53 are indicated by different shading patterns. The surface of the piezoelectric element 4 is divided into concentric circular regions, and the electrodes 51, 52, and 53 are arranged, from the outside to the center, as the electrodes 51, 52, 53, 51, 52, and 53. In order to couple the electrode 51, 52, or 53 present in the interior region with the respective electrode 51, 52, or 53 present in the outer region, the electrodes 51, 52, and 53 other than the electrode 53 present in the inner region do not appropriate 360° of center angle in the concentric circle, so that margin exists for extending the contacting portion achieving the connection between pairs of the electrodes 51, 52, and 53 to cover a portion of the circular shape to achieve the connection between the electrodes 51, 52, or 53.

All of the electrodes 51, 52, and 53 are arranged in two regions, a region (outer region) in the vicinity of the circumferential edge of the disk surface, and a region (interior region) closer to the center of the disk surface. For example, the electrodes 52 and 53 are arranged between the outer region in the vicinity of the circumferential edge and the more central region of the electrode 51, and the electrodes 52 and 53 are similarly configured. In other words, the other electrodes 52 and 53 are arranged in the separating portion (gap portion) of the electrodes 51 arranged in the outer region in the vicinity of the circumferential edge and the more central region. This positional relationship is similar for the electrodes 52 and 53.

The disk-shaped piezoelectric element 4, or the vibrating body attached to the piezoelectric element 4, is supported at the circumferential edge portion by a frame as illustrated in another embodiment, and thus frequency characteristics differ between the vicinity of the circumferential edge and the more central portion of the disk surface. However, each of the electrodes 51, 52, and 53 is arranged in a nested pattern in the aforementioned manner, and thus the electrodes 51, 52, and 53 for each bit are arranged without bias on the surface of the piezoelectric element 4, and frequency characteristics of the piezoelectric element 4, or the vibrating body attached to the piezoelectric element 4, can be made uniform.

Due to the aforementioned arrangement of the electrodes 51, 52, and 53, bit-to-bit mutual differences in the frequency characteristics decrease and sound quality further increases for the digital speaker 1 of the present embodiment.

Embodiment 2

Embodiment 2 illustrates a speaker system including the digital speaker 1 of Embodiment 1, and illustrates earphones that include the speaker system. The digital speaker 1 (a tweeter 11, a squawker 12, and a woofer 13) is similar to Embodiment 1, and detailed description is omitted.

Figure 3:
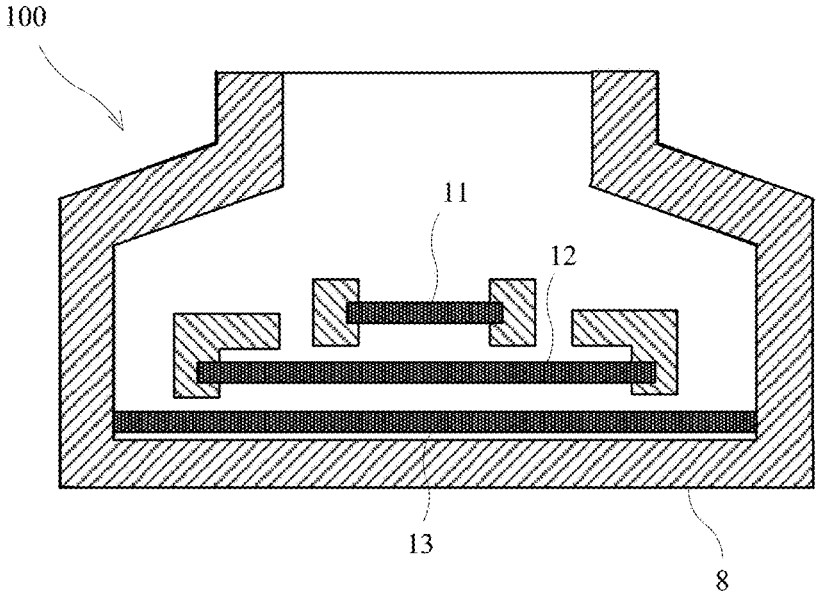
FIG. 3 is a drawing illustrating a configuration of a speaker system.

FIG. 3 is a drawing illustrating a configuration of a speaker system 100. The circumferential edges of the tweeter (speaker used for a high sound range) 11, the squawker (speaker used for a middle sound range) 12, and the woofer (speaker used for a low sound range) 13 that are the digital speakers 1 are supported by a frame 8. The frame 8 is molded in a cylindrical shape of constant wall thickness using a material such as metal or a resin. The piezoelectric element 4 supported by the frame 8 is disk-shaped and is illustrated in cross section in the figure. However, any desired shape may be used, such as a rectangle or an ellipse.

The voltage source 6, the signal division circuit 2, and the like of the digital speaker 1 are not illustrated. These components are provided in the lower portion of the figure. Specifically, relative to the tweeter 11, these components are provided further away than the woofer 13 and outside the frame 8. Further, the frame 8 can be made part of the earphones, specifically, can be made the portion inserted in to the ear canal.

Three digital speakers are present in the speaker system 100 of Embodiment 2, and thus a method of dividing the digital signal into three components is described below. The tweeter 11, the squawker 12, and the woofer 13 correspond to separate frequency bands. Thus the digital signal indicating the intensity distribution in the time domain undergoes Fourier transformation to find the intensity distribution of the digital signal in the frequency domain, the frequency region in which the intensity distribution is found is divided at crossover frequencies into three frequency regions, and inverse digital Fourier transformation is performed for each of the divided frequency regions, thereby enabling the forming of three digital signals in the time domain. Frequency division is in this manner is easy for the digital signal in comparison to an analog signal. Further, rather than dividing at the crossover frequencies uniformly at boundary values, the division at the crossover frequencies may be performed by suitable windowing processing. Here, the term "crossover frequencies" refers to the boundaries of the frequencies corresponding to each of the tweeter 11, the squawker 12, and the woofer 13. Further, the term "windowing processing" refers to signal processing that can include in the frequency domain a fixed amount of signal present outside the boundaries.

The three digital signals divided in the aforementioned manner are input to the respective signal division circuit 2 of the tweeter 11, the squawker 12, and the woofer 13. Thereafter, the digital signals are converted to sound pressure by the tweeter 11, the squawker 12, and the woofer 13 in the same manner as in Embodiment 1.

In accordance with the speaker system of the present embodiment as described above in detail, a miniaturized speaker system 100 having high sound quality can be achieved. Further, by use of the speaker system of the present embodiment for earphones, earphones can be achieved that have high sound quality.

Further, if sound quality of the piezoelectric element 4 due to low frequencies is unsuitable, rather than using digital speakers for the squawker 12 and the woofer 13, dynamic speakers or the like may be used. However, the digital speaker is preferably used for the tweeter 11.

Further, the squawker 12 may be omitted from the digital speaker, the speaker system, and the earphones, and the speaker system and the earphones may include just the tweeter 11 and the woofer 13, or alternatively, the digital speaker, the speaker system and the earphones may be configured to include 4 or more speakers. That is to say, the number of speakers is not limited to 3.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

This application claims the benefit of Japanese Patent Application No. 2015-102347, filed on May 20, 2015, including the specification, claims, and drawings, the entire disclosure of which is incorporated by reference herein.

INDUSTRIAL APPLICABILITY

The present disclosure is considered for many audio equipment manufacturers to have applications related to digital speakers, speaker systems, and earphones that are miniaturized and have high sound quality.

REFERENCE SIGNS LIST

1 Digital speaker
11 Tweeter
12 Squawker
13 Woofer
2 Signal division circuit
31 Post-division digital signal
32 Post-division digital signal
33 Post-division digital signal
4 Piezoelectric element
51 Electrode
52 Electrode
53 Electrode
6 Voltage source
71 Switch
72 Switch
73 Switch
8 Earphones (frame)
100 Speaker system

The invention claimed is:

1. A digital speaker comprising:

a signal division circuit for dividing an inputted digital signal into bit units;

n D/A converters for, based on n post-division digital signals divided by the signal division circuit, output of a voltage in the bit units, n being greater than or equal to 2; and one piezoelectric element including n electrodes, spaced apart from each other, for receiving the voltage output from the D/A converters;

wherein the following formula is satisfied:

$$Si \cdot Vi = r2^{i-1}$$

wherein, in the formula, Vi is the voltage output from the D/A converter processing a post-division digital signal for an i-th bit from a lower order bit of the digital signal, i is an integer ranging from 1 to n, Si is a surface area of an electrode of the electrodes receiving the voltage Vi, and r is a constant.

2. The digital speaker according to claim 1, wherein Vi is a constant.

3. The digital speaker according to claim 2, wherein a voltage generated by a voltage source is supplied to all of the n electrodes.

4. The digital speaker according to claim 1, wherein the piezoelectric element has a disk shape; and the surface of the piezoelectric element is divided into concentric circular regions, each electrode of the n electrodes being disposed in 2 or more of the regions, the other n−1 electrodes being disposed in a separating portion of the electrode disposed in the 2 or more regions.

5. A speaker system for dividing a sound range by frequency band and outputting the divided sound ranges separately to 2 or more speakers, wherein a speaker of the speakers for outputting a highest frequency band includes:

a signal division circuit for dividing an inputted digital signal into bit units;

n D/A converters for, based on n post-division digital signals divided by the signal division circuit, output of a voltage in the bit units, n being greater than or equal to 2; and one piezoelectric element including n electrodes, spaced apart from each other, for receiving the voltage output from the D/A converters;

wherein the following formula is satisfied:

$$Si \cdot Vi = r2^{i-1}$$

wherein, in the formula, Vi is the voltage output from the D/A converter processing a post-division digital signal for an i-th bit from a lower order bit of the digital signal, i is an integer ranging from 1 to n, Si is a surface area of an electrode of the electrodes receiving the voltage Vi, and r is a constant.

6. A speaker system for dividing a sound range by frequency band and outputting the divided sound ranges separately to 2 or more speakers, wherein each of the speakers includes:

a signal division circuit for dividing an inputted digital signal into bit units;

n D/A converters for, based on n post-division digital signals divided by the signal division circuit, output of a voltage in the bit units, n being greater than or equal to 2; and one piezoelectric element including n electrodes, spaced apart from each other, for receiving the voltage output from the D/A converters;

wherein the following formula is satisfied:

$$Si \cdot Vi = r2^{i-1}$$

wherein, in the formula, Vi is the voltage output from the D/A converter processing a post-division digital signal for an i-th bit from a lower order bit of the digital signal, i is an integer ranging from 1 to n, Si is a surface area of an electrode of the electrodes receiving the voltage Vi, and r is a constant.

7. Earphones comprising the speaker system according to claim 5.

* * * * *